United States Patent [19]

Leibundgut

[11] 3,967,814

[45] July 6, 1976

[54] HIGH CAPACITY HAND PORTABLE JACK

[75] Inventor: James A. Leibundgut, Waterford, Wis.

[73] Assignee: Hein-Werner Corporation, Waukesha, Wis.

[22] Filed: Apr. 30, 1975

[21] Appl. No.: 573,171

[52] U.S. Cl. ..... 254/8 B
[51] Int. Cl.[2] ..... B66F 3/24
[58] Field of Search..... 254/8 B, 8 R, 2 B, 2 R, 254/9 B, 9 R, 10 B, 10 R, 124

[56] References Cited

UNITED STATES PATENTS

| | | | |
|---|---|---|---|
| 1,844,585 | 2/1932 | Manley | 254/8 B |
| 2,032,309 | 2/1936 | Rechard | 254/2 B |
| 2,080,963 | 5/1937 | Fiedler | 254/2 B |
| 2,404,577 | 7/1946 | Jackson | 254/8 B |
| 2,906,497 | 9/1959 | Wolf | 254/10 B |
| 3,807,694 | 4/1974 | Butorac | 254/8 B |

*Primary Examiner*—Al Lawrence Smith
*Assistant Examiner*—Robert C. Watson
*Attorney, Agent, or Firm*—Andrus, Sceales, Starke & Sawall

[57] ABSTRACT

A high capacity portable jack which has a chassis consisting of front and rear axles supported on small wheels with parallel laterally spaced tension members connected to and extending between the axles. A jack having a lift arm connected directly to the rear axle and a hydraulic unit pivoted at the rear generally centrally of the lift arm and directly connected at the forward end to the front axle to subject the tension members only to a force tending to stretch the tension members to thereby require only lightweight tension members when the hydraulic unit is operated to raise the jack and lift an object with the saddle at the forward end of the jack.

8 Claims, 6 Drawing Figures

HIGH CAPACITY HAND PORTABLE JACK

BACKGROUND OF THE INVENTION

There has been a requirement for a lightweight, high capacity jack which can be hand carried by a home owner, if desired, in order to transport it to work on his automobile or store it in the trunk of his automobile or otherwise use the jack. Automobile repairmen and garage mechanics also have use for such a jack. The present invention is therefore directed to a small, rugged jack which is a self-contained unit and constructed with the lift arm, hydraulic unit and tension members and the chassis in the general form of a triangle so that the tension members connecting the axles and wheels of the jack are not subjected to a bending moment or vertical forces as is the usual case with the jacks on the market.

SUMMARY OF THE INVENTION

In general the invention is directed to a jack having a chassis consisting of front and rear axles supported on small wheels and a pair of laterally spaced, parallel tension members which extend between the axles adjacent the inside of the wheels. A pair of laterally spaced side members of generally triangular shape provide a lift arm which is directly, pivotally connected to the rear axle and extends forwardly of the jack to a line slightly removed from the front axle.

The lift arm encloses the operating mechanism of the jack. The operating mechanism has a hydraulic head generally centrally located of the lift arm which is connected to a reservoir of fluid which may be located within the lift arm. The head is pivoted to the side members of the lift arm generally by a large shaft and has a hydraulic cylinder connected to the forward side thereof and from the forward end of the cylinder there extends a piston which is directly pivoted to the central portion of the forward axle. The hydraulic unit is contained within the lift arm.

A saddle for lifting an object when the jack is operated is located at the forward end of the jack and has a pair of laterally spaced legs which are pivotally connected to the forward end of a pair of laterally spaced parallel links which extend rearwardly and are pinned together adjacent the hydraulic head and to the legs of an irregularly shaped link which is pivotally connected to the handle socket in which a handle can be located to actuate the jack. The forward lower corner of the hydraulic head lies between the pin holding the parallel links and a second pin also projecting through the legs of the irregularly shaped links. As a result of this construction, the irregularly shaped link is prevented from rotation relative to the power head when the jack is actuated, and this in turn prevents rotation, through the parallel links, of the saddle.

When it is desired to raise the jack, a release valve in the fluid return to the reservoir from the cylinder is rotated clockwise. This is accomplished by engaging it with the inner end of the handle. The jack is raised by movement of the handle disposed in the handle socket upwardly and downwardly by the operator which pumps fluid from the reservoir into the hydraulic cylinder to extend the piston attached to the front axle. This pumping action is obtained by a plunger operated by a pin in a limited slot in a bracket or the like connected to the head and to the legs of the socket of the handle so that when the handle is actuated the plunger is reciprocated in the head to pump fluid to the hydraulic cylinder from the reservoir.

When it is desired to lower the jack, the handle which is in engagement with the release valve is rotated counterclockwise to open the return conduit in the hydraulic head. The fluid then flows from the hydraulic cylinder through the head and back to the reservoir and the jack is gradually lowered. The lowering of the jack is aided by the tension applied by a spring connected to the forward axle and the hydraulic head. The handle which normally is provided in two parts is disassembled and stored in the tubes which are welded to the tension members of the jack.

Figure 1:
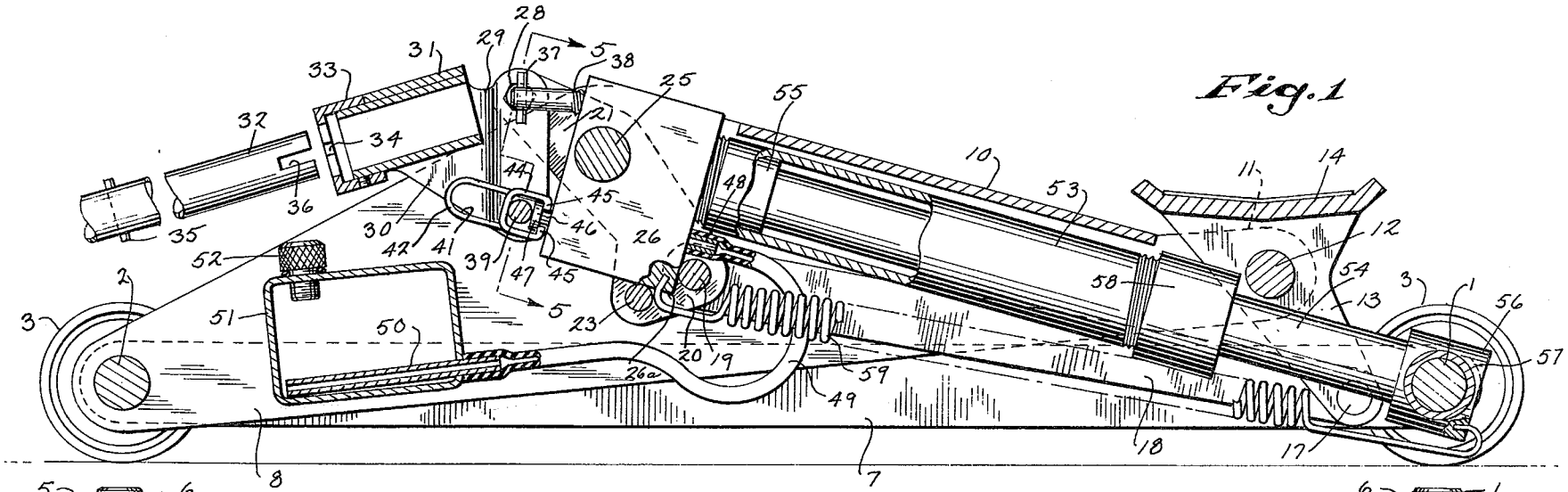
FIG. 1 is a longitudinal elevational view of the jack of the invention in lowered position with parts broken away and in section with the section taken on line 1—1 of FIG. 2.
Figure 2:
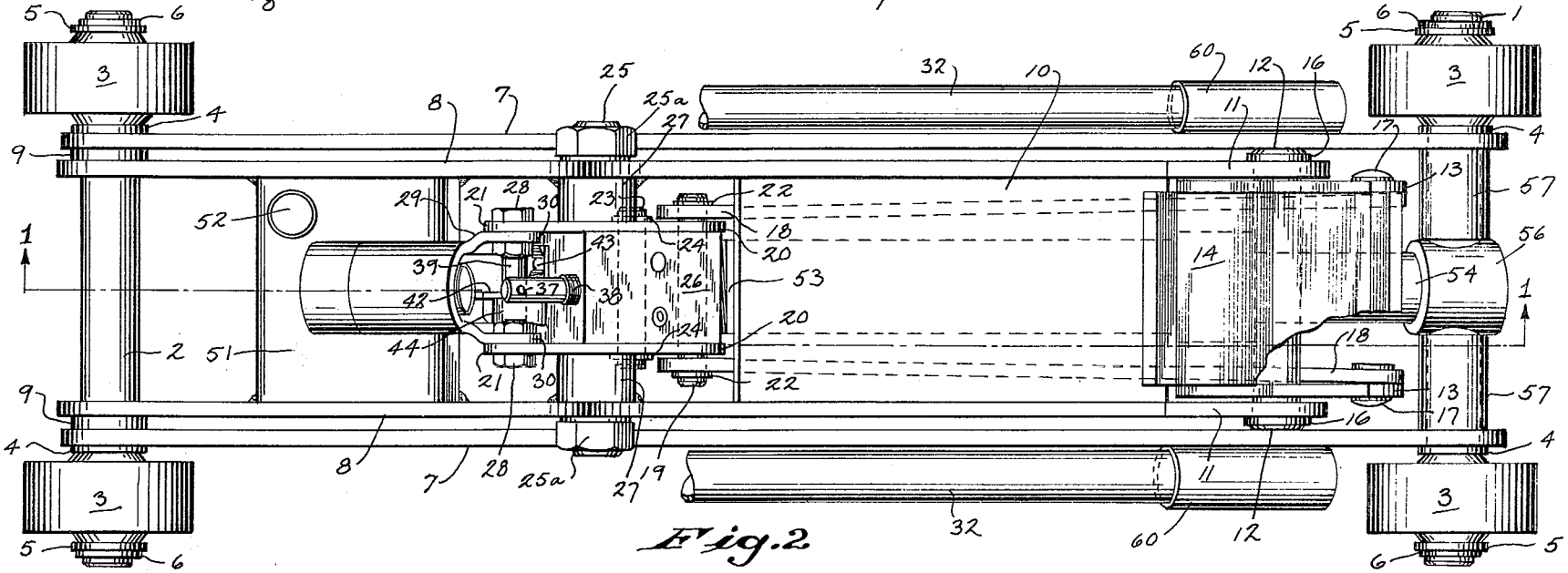
FIG. 2 is a top plan view of FIG. 1.
Figure 3:
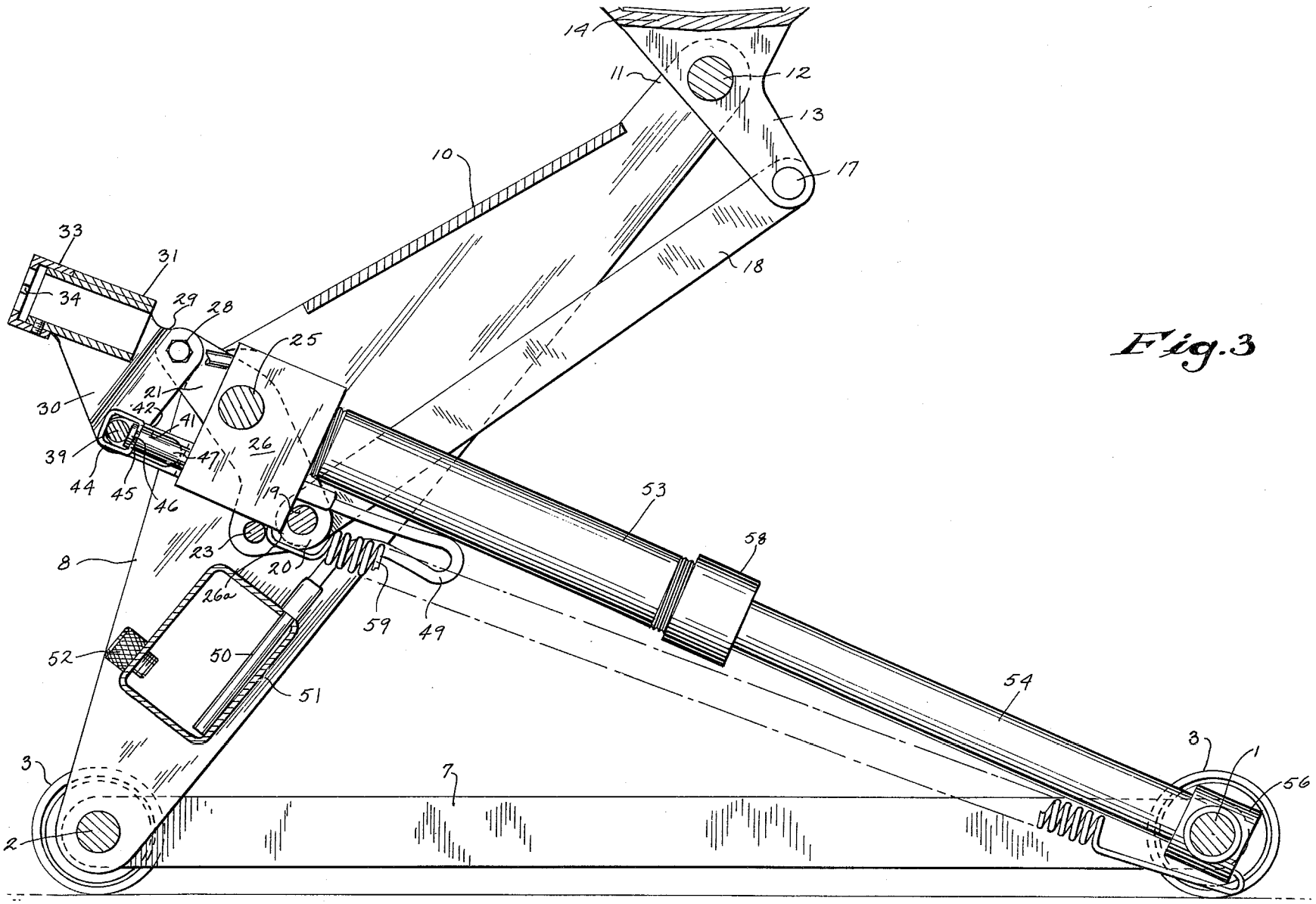
FIG. 3 is a longitudinal elevational sectional view similar to FIG. 1 but illustrating the jack in a raised position with parts in section.
Figure 4:
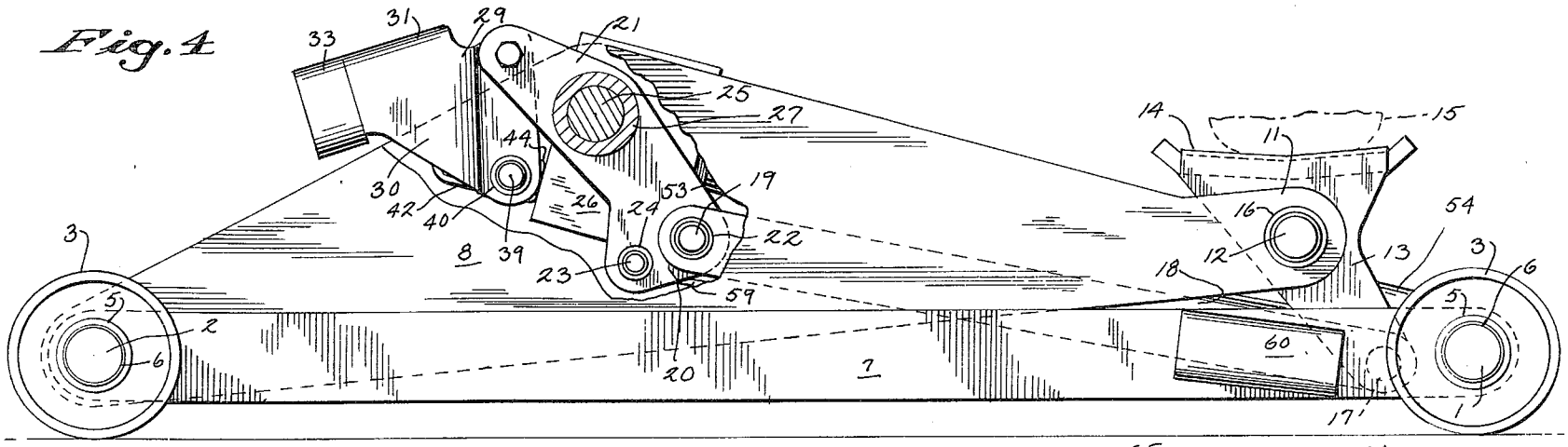
FIG. 4 is a side elevational view of the jack in a lowered position with parts broken away and illustrating an object supported on the saddle.

Referring to the drawings there is illustrated a jack having a chassis comprising front axle 1 and rear axle 2 which is supported on a surface by the four small wheels 3. Each wheel 3 is rotatably assembled on the axles and held between inner washers 4 and outer washers 5 and secured on the end of each axle by respective retaining rings 6. The chassis is completed by the laterally spaced tension members 7 which extend parallel to each other on each side of the jack and are loosely assembled at the opposite ends over both the front and rear axles immediately inside the respective inner washers 4. Tension members 7 may be lightweight metal side bars of flat or rod type or of other construction such as cables or the like which are capable of withstanding tension in service.

A lift arm in the form of a housing is located above the chassis and consists of laterally spaced somewhat triangular shaped side plates 8 which extend parallel to each other between the axles of the jack. The rear ends of side plates 8 are assembled over the rear axle 2 inside of tension members 7 and each side plate 8 has an annular abutment 9 which extends around rear axle 2 between the respective side arms 8 of the lift arm and the tension members 7 so that the lift arm can rotate on the rear axle.

The downwardly sloping forward portion of the side plates 8 of the lift arm are closed by an upper flat plate 10 which is welded to the side plates 8 to rigidly reinforce them centrally of the jack and complete the lift arm.

The forward end of each side plate 8 of the lift arm terminates in forwardly extending ears 11. A shaft 12 extends crosswise of ears 11 of side plates 8 of the lift arm and through the laterally spaced legs 13 of a lifting saddle 14 which is welded to legs 13 and disposed to engage an object such as an automobile axle 15 to raise the axle so that a tire can be changed thereon or other repairs made. Shaft 12 is held in place on the outer sides of ears 11 by the retaining rings 16.

Each leg 13 of saddle 14 is secured by a stud 17 to the forward end of a link 18 located inside legs 13 and upon which the legs 13 are free to rotate. Links 18 are laterally spaced from each other and extend rearwardly of the jack underneath the upper plate 10 in parallel spaced relation.

The rear portion of links 18 are pivoted to a pin 19 which projects through the respective links 18 and also through laterally spaced legs 20 of an irregular shaped link 21 which extends upwardly to the rear of upper plate 10 of the housing. The legs 20 of link 21 are each located inside of parallel links 18. The respective links are held on pin 19 by the pin clips 22 located on the outer end of each pin 23.

A smaller pin 23 also extends through the laterally spaced legs 20 of irregular shaped links 21 to the rear of pin 19 and is held in place by the pin rings 24.

The irregular shaped links 21 are pivotally connected to the lift arm side plates 8 by a main shaft 25 which extends through the legs of the link 21. Shaft 25 is threaded on the outside to receive the jam nuts 25*a* on both ends to secure the main shaft 25 to link 21.

Shaft 25 also extends through the block or cylinder head 26 which is adapted to receive liquid for operating the jack. The block 26 is centrally located on shaft 25 between the oppositely disposed spacers 27 which are welded to the inside of lift arms 8.

Cylinder head 26 is generally rectangular in shape and the forward corner 26*a* of cylinder head 26 rides between small pin 23 and link pin 19 to prevent rotation of the link 21 with respect to the head 26.

The outer end portion of irregular shaped links 21 is pivotally secured by bolts 28 to the handle bracket 29 which has side members 30 located inside of links 21 within which is welded the socket 31 for receipt of the handle 32 to actuate the jack. The socket 31 has a collar 33 secured to it at the outer end with oppositely disposed notches 34 therein with which the oppositely projecting pins 35 on the handle can be registered when handle 32 is inserted into the socket. When the handle 32 is rotated in socket 31, once it leaves the area of notches 34, it cannot be removed from the socket 31 without rotation to register pins 35 with notches 34. Only a portion of the handle is illustrated. Ordinarily it is provided of two parts with a grip provided on the part which is not shown.

The inner end of handle 32 is provided with the oppositely disposed notches 36. When the handle 32 projects forwardly through the socket 31 the notches 36 slide over the pins 37 located on opposite sides of the outer end of release valve 38 which is threaded into the hollow cylinder head 26. Rotation of release valve 38 by handle 32 controls the flow of fluid within cylinder head 26.

Side members 30 of handle bracket 29 are generally triangular in shape and the pin 39 extends through the side member 30 beneath the handle socket 31. The pin 39 is held in the side members 30 by the retaining rings 40 and between side member 30 pin 39 rides in the elongated slot 41 in the bracket 42 of right angle shape which is secured to the top of cylinder head 26 by screw 43. A split ring 44 is assembled around pin 39 and the inner ends 45 of ring 44 turn inwardly and are lodged beneath the head 46 of the plunger 47 which extends within cylinder head 26. The plunger 47 is actuated by handle bracket 29 to pump hydraulic fluid through the head, and the movement of plunger 47 is governed by the length of slot 41 in bracket 42.

A conduit 48 projects from the lower end of block 26 and the flexible tube 49 is assembled over conduit 48 at one end and is connected to conduit 50 which extends within the sump or reservoir 51 at the other end to supply fluid to cylinder head 26. Reservoir 51 is of somewhat rectangular shape and, as shown in the drawings, is welded to the lift arms 8 at the rear end of the jack. The filler plug 52 may be removed from sump 51 to fill the reservoir 51 with fluid.

The cylinder 53 of the hydraulic unit is threaded into the bottom of cylinder head 26 and a piston rod 54 extends outwardly of cylinder 53 from the piston head 55 which is actuated within cylinder 53. The lower end of piston rod 54 is secured to block 56 which is pivotally assembled around the front axle 1. The spacer members 57 extend freely around axle 1 on both sides of piston block 56 between block 56 and the respective tension member 7. The piston 54 is sealed against leakage at the end of cylinder 53 by sealing material (not shown) which is held in place by the nut 58 threaded onto the end of cylinder 53.

In order to assist in return of the piston rod 54 when the jack is to be lowered, a coil spring 59 is secured at the forward end to cylindrical block 56 and at the rear end to the cylinder head 26.

When the jack is not in service the ends of handle 32 which normally is of two pieces are stored by inserting them into the tubes 60 which are welded to the respective tension members 7. Tubes 57 hold the handle members securely along the side of the tension members 7.

The raising of the jack is controlled by the upward and downward movement of the handle socket which effects the pumping of fluid from reservoir 51 through cylinder head 26 and thence into the cylinder 53 to actuate piston 54 to raise the jack and saddle 14.

Figure 6:
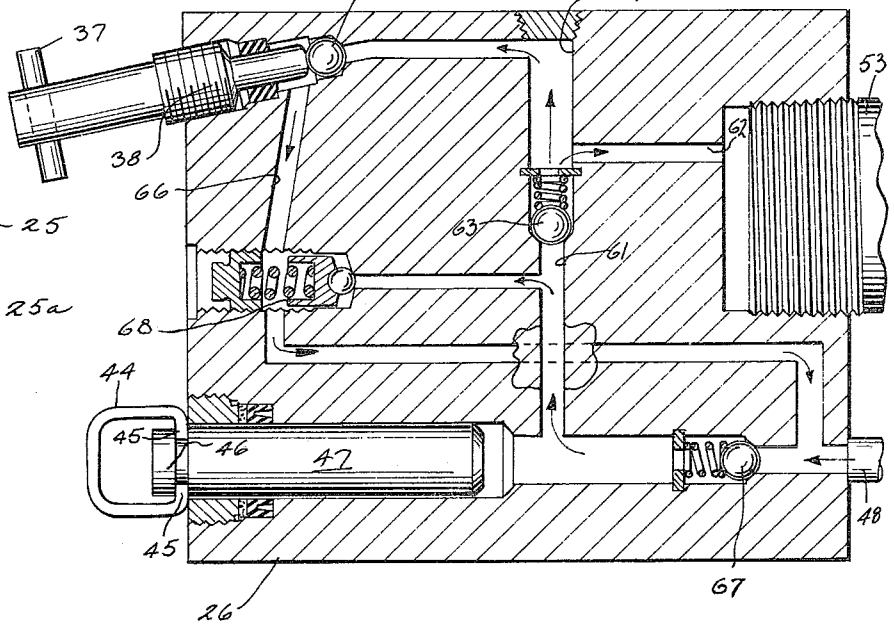
FIG. 6 is a diagrammatic sectional view of the cylinder head and a portion of the cylinder illustrating the flow of fluid through the head to the cylinder.
Figure 5:
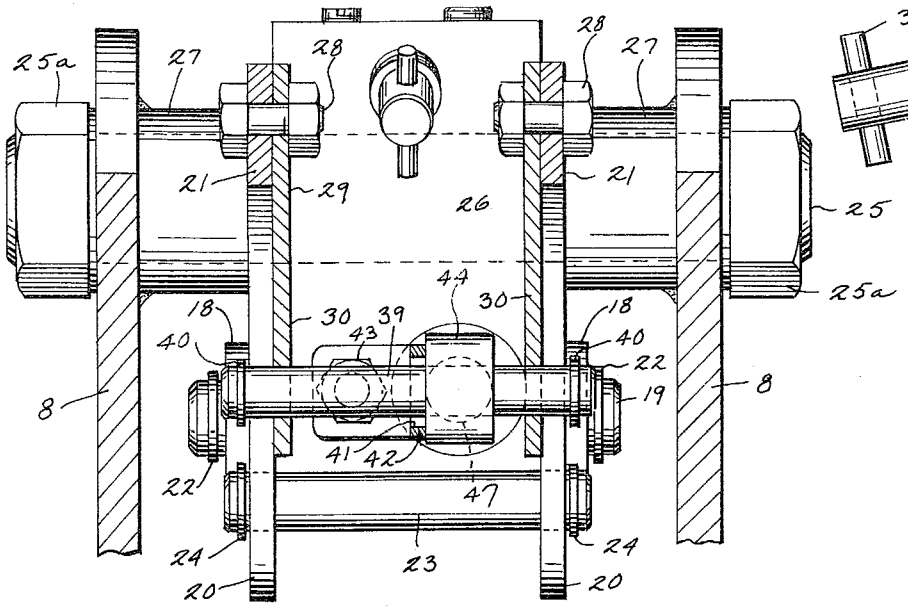
FIG. 5 is a sectional view taken on line 5—5 of FIG. 1.

The flow of fluid within cylinder head 26 can be accomplished by various constructions. Under one of these, as illustrated in FIG. 6, the conduit 48 within cylinder head 26 is connected to the cylinder 53 by passage 61 and inlet outlet passage 62 so when fluid flows from reservoir 51 through conduit 50, tube 49 to conduit 48, it will be discharged into the cylinder 53. The flow of fluid to the cylinder 48 is accomplished by downward and upward actuation of the handle socket 31 by handle 32 which in turn through side members 30 of bracket 29 oscillates pin 39 within slot 41 and this moves split ring 44 in engagement with head 46 of plunger 47 back and forth to provide inward and outward movement of plunger 47 within the cylinder head 26. Plunger 47 operates in a chamber connected to conduit 48 at the junction of conduit 61 so as plunger 47 is pumped back and forth it draws fluid from reservoir 51 and discharges the fluid into cylinder 53 through the respective conduits 48, 61 and 62 and against the piston head 55. This results in gradual extension of piston 54. Flow of fluid rearwardly in conduit 61 is prevented by check valve 63. The piston rod 54 at this time is acting against both axles 1 and 2 to tend to spread the axles apart because of the connection of piston 54 to forward axle 1 by cylindrical block 56 and by connection of the cylinder head 26 to the rear axle 2 through the main shaft 4 which extends through block 26 and the side arms 8 of the lift arm which are connected to the rear axle. The force exerted against the axles is absorbed by the tension members 7.

As the jack is raised saddle 14 is maintained in a substantially horizontal position as it rises with the jack. This is accomplished by the parallel links 18 which are secured at the forward end to the legs 13 of saddle 14 and joined together at the rear end and to the legs 21 of irregular shaped link 20.

In addition the main shaft 25 extends through both side plates 8 of the lift arm above pin 19 and the shaft 12 extends through the laterally spaced legs 13 of saddle 14 above the connection of links 18 to legs 13 of the saddle. This provides four points in a parallelogram type structure on each side of the jack consisting of the connection of each link 18 to each leg 13 of the saddle and the connection of each link 18 to the irregular shaped link 20 together with the connection of each side plate 8 by shaft 25 and of each leg 13 of the saddle by the shaft 12. Therefore all four points of the parallelogram linkage structure on each side of the jack move both horizontally and vertically when the jack is actuated.

When the jack is being pumped to an elevated position, the release valve 38 has previously been rotated by handle 32 through engagement of notches 36 on the handle with pin 37 to a position to close the return conduit 64 which also extends within cylinder head 26 and is connected to the inlet outlet conduit 62 in turn connected to cylinder 53. Return conduit 64 has a ball and seat arrangement 65 therein and plug 38 holds the ball and seat 65 in closed contact when the jack is being pumped upwardly to close return conduit 64. Another return conduit 66 is connected to return conduit 64 above ball and seat 65 and to the inlet conduit 48 below a second check valve 67 in conduit 48 for discharge of return fluid to the reservoir 51.

When it is desired to lower the jack, handle 32 is in engagement with release valve 38 and is rotated counterclockwise to lift valve 38 and disengage ball and seat 65 to open return conduit 64 to conduit 66 and thence to conduit 48 for return of the hydraulic fluid to reservoir 51. The cylinder 53 is thus gradually lowered as piston rod 54 recedes into cylinder 53 and is aided in this movement by coil spring 59. In the event that when the jack is being pumped upwardly the pressure in conduit 61 is excessive, a relief valve 68 is connected to conduit 61 so that it can be lifted off its seat and provide for passage of fluid into the chamber of valve 68 and into return conduit 66 and back to conduit 48.

Although all of the mechanism for developing the pressure for extending the piston 54 is described as located within the jack, it could be located remotely from the jack. In the design of the jack, the tension members 7 can be of light weight such as a thin strip of metal or cable or the like because when the jack is lifting an object the members 7 are placed only under tension to resist the force exerted by the hydraulic unit to tend to spread the axles apart and they are not subjected to twisting, bending or compressive forces. Only the lift arm is subjected to bending stresses when under load.

The jack of the invention has a high load handling capacity and yet is of light weight so that it can easily be transported by hand if desirable. Even though of light weight the jack has a greater lifting capacity and greater lifting range than the jacks now available.

Various modes of carrying out the invention are contemplated as being within the scope of the following claims particularly pointing out and distinctly claiming the subject matter which is regarded as the invention.

I claim:

1. A lightweight hand portable jack, comprising a chassis having front and rear axles and wheels supporting the axles, a pair of laterally spaced parallel tension members connected at opposite ends to each of the axles and free of other members of the jack, a lift arm of generally triangular configuration pivoted directly to the rear axle and extending forwardly of the jack to a line adjacent to the front axle, a hydraulic unit directly pivoted at the forward end to the front axle and pivoted at the rear end to the upper portion of the lift arm generally centrally of the jack to actuate the lift arm, a lifting saddle having depending members pivotally supported at the forward end of the jack, link means pivoted at the forward end of the jack to the saddle and at the rear end to the hydraulic unit, and means to actuate the hydraulic unit to raise the lift arm operating against the rear axle and the hydraulic unit operating against the front axle and thereby raise the saddle, the said tension members only being subject to tension thereby requiring only lightweight members and the bending moment developed in the jack being absorbed solely by the lift arm.

2. The jack of claim 1, and the tension members being of lightweight flat strips of metal.

3. The jack of claim 1, and the link means being laterally spaced elongated parallel links, and the lift arm having a pair of laterally spaced side plates of generally triangular shape, a first shaft extending through the side plates generally centrally of the plates and through an upper part of the hydraulic unit, a second shaft extending through the forward end of the side plates of the lift arm and the upper portion of the depending members of the saddle, pin means connecting the forward end of the parallel links to the depending legs of the saddle below the second named shaft, and a third shaft extending through the rear ends of the parallel links below the first named shaft and engaging the hydraulic unit to thereby provide four connections on each side of the jack in a parallelogram type structure with the connections moving both horizontally and vertically when the jack is actuated.

4. The jack of claim 3, and the hydraulic unit having a head with a lower front corner, an irregular shaped link having legs enclosing the head, a handle socket pivoted at the inner portion to the irregular shaped link and open rearwardly of the jack, a handle adapted to be inserted into the socket to raise the jack, a fourth shaft extending through the lower part of the legs of the irregular shaped link at the lower end of the rear side of the lower front corner of the head and said third shaft extending through the rear ends of the elongated links extending along the forward side of the lower front corner of the head to thereby confine the head against rotation.

5. The jack of claim 4, and a hydraulic cylinder connected to the forward end of the head, a piston projecting forwardly from the cylinder and being the member of the hydraulic unit connected to the front axle and the head being the member of the hydraulic unit connected to the lift arm, a reservoir of power fluid associated with the hydraulic unit, inlet conduits within the head connected to the cylinder and the fluid reservoir to provide a flow of fluid from the fluid reservoir through the head to the cylinder to actuate the piston, return conduits provided in the head to return fluid to the reservoir, means to close said return conduits, a plunger extending within the head to effect flow of fluid in the inlet conduits to the cylinder from the reservoir, restricted means connecting the plunger to the lower portion of the handle socket for reciprocation of the plunger when the handle socket is moved upwardly and downwardly by the handle to actuate the plunger and pump fluid to the cylinder and extend the piston forwardly to thereby raise the jack.

6. The jack of claim 5, and the means to close the return conduit being a release valve threaded into the head, oppcsitely disposed pins projecting from the valve on the outside of the head, oppositely disposed notches provided on the inner end of the handle adapted to be placed in registry with the pins on the valve when the handle extends through the socket for rotating the valve to an open or closed position.

7. The jack of claim 4, in which the handle socket has oppositely disposed notches at the entrance end, and oppositely disposed pins slightly removed from the forward end of the handle to permit insertion into the socket when the pins are registered with the notches but preventing removal of the handle upon rotation of the handle to place the pins out of registry with the notches.

8. The jack of claim 5, and a coil spring connected at the rear to the cylinder head and at the forward end to the piston at the connection to the front axle to aid in collapsing the jack when the jack is to be lowered.

* * * * *